US005607008A

United States Patent [19]

Niederer

[11] Patent Number: 5,607,008

[45] Date of Patent: Mar. 4, 1997

[54] METHOD OF MONITORING THE CONDITION OF SOILING AND /OR CALCIFICATION OF HEAT EXCHANGERS IN HEATING AND COOLING INSTALLATIONS

[76] Inventor: Armin Niederer, Rotengasse 361, FL-9391 Ruggell, Liechtenstein

[21] Appl. No.: 210,661

[22] Filed: Mar. 18, 1994

[30] Foreign Application Priority Data

Mar. 23, 1993 [DE] Germany ..... 43 09 313.2

[51] Int. Cl.[6] ..... F34H 9/20; F24D 19/10; F28G 13/00

[52] U.S. Cl. ..... 165/11.1; 165/95; 165/299

[58] Field of Search ..... 165/1, 11.1, 95, 165/39

[56] References Cited

U.S. PATENT DOCUMENTS

| | | | |
|---|---|---|---|
| 4,390,058 | 6/1983 | Otake et al. | 165/11.1 |
| 4,485,449 | 11/1984 | Knauss | 165/11.1 |
| 4,718,478 | 1/1988 | Huber | 165/11.1 |
| 4,766,553 | 8/1988 | Kaya et al. | 165/11.1 |
| 5,385,202 | 1/1995 | Drosdziok et al. | 165/11.1 |

FOREIGN PATENT DOCUMENTS

| | | | |
|---|---|---|---|
| 0028940 | 2/1982 | Japan | 165/11.1 |
| 0777386 | 11/1980 | U.S.S.R. | 165/11.1 |

*Primary Examiner*—John K. Ford

*Attorney, Agent, or Firm*—Laff, Whitesel, Conte & Saret, Ltd.

[57] ABSTRACT

In a method of monitoring the condition of soiling and/or calcification of heat exchangers in heating installations, subsequent operational data of temperature and pump speed are collected in turns during the operation and compared with the initial operational data of temperature and pump speed collected in an initial condition, for instance when an installation is put into service initially. When an admissible deviation of the subsequent operational data from the initial operational data is exceeded, which is as a rule to be attributed to the soiling and/or calcification of the heat exchanger, a corresponding malfunction signal is emitted or the heating installation is switched off. In accordance with the method, a conventional heating installation is provided with a monitoring device, by means of which the soiling and/or calcification of the heat exchanger is automatically checked in turns.

14 Claims, 2 Drawing Sheets

METHOD OF MONITORING THE CONDITION OF SOILING AND /OR CALCIFICATION OF HEAT EXCHANGERS IN HEATING AND COOLING INSTALLATIONS

BACKGROUND OF THE INVENTION

1. Field of the Invention

The invention relates to a method of monitoring the condition of soiling and/or calcification of heat exchangers in heating installations comprising a primary circuit containing a heating medium, in particular heating water, and a secondary circuit containing a medium to be heated, in particular service water, the heating-up process of the medium to be heated being controlled on the basis of operational data, namely of temperatures of the heating medium and the medium to be heated as well as the triggering data for pumps for conveying the heating medium and/or the medium to be heated through the heat exchanger by means of a heating-up control device. Further, the invention relates to a heating installation which is provided with a monitoring device putting into practice the method according to the invention. In connection with the method according to the invention and the corresponding heating installation, emphasis must in advance be put on the fact that the invention can be used in heating installations as well as in cooling installations. Although the focus of this is a corresponding heating installation so as to avoid any wording of the claims that would be difficult to understand, it goes without saying that a corresponding monitoring method will also make use of the invention in connection with a cooling installation.

2. Background Art

A basic problem with heating installations having a primary circuit containing a heating medium such as heating water and a secondary circuit containing a medium to be heated, for instance service water resides in that, while the installation is in service, the heat exchanger thermally coupling the two circuits may be clogged by coagulation, accumulation of mud, soiling, calcification or similar deposits as a result of physical or chemical reaction during the change of temperature of the heating medium or the to-be-heated medium while the heat exchange takes place, since the mentioned soiling and calcification may deposit on the heat exchanger surfaces and/or in the supply conduits to the exchanger surfaces. As a result, the parameters on the basis of which the heating installation is designed, such as flow resistances, flow rates, pressures, temperatures, energy conditions and performances, K-values etc., change permanently, which affects the service behavior of the heating-up control unit negatively. This jeopardizes any impeccable functioning of the heating installation in conformity with its design.

To avoid the afore-mentioned problems it is necessary in due time to replace or at least clean the heat exchanger or such other parts of the installation as are subject to soiling and/or calcification. Since, however, the rate by which soiling and/or calcification deposit highly depends on local conditions such as water quality, there is no possibility in advance to determine the time by which malfunction will occur. Nevertheless, such deposits should be recognized at an early stage for any subsequent damages such as a total breakdown, interruptions in operation, excessive energy consumption, the destruction of parts of the installation etc. to be prevented. Moreover, a heat exchanger for instance is easier to clean when total clogging of the flow channels has not yet occurred.

To solve the problem outlined above, there are monitoring systems that monitor the degree of soiling of heat exchangers actively. These systems are for instance based on measuring the pressure differences between the supply and the discharge of the heat exchanger on the secondary side. Monitoring the flow throughput per time unit that decreases with the increase in soiling has been put into practice.

Such monitoring systems have the disadvantage that the parts of the installation responsible for measuring such as pressure gauges or flow-meters are also in contact with the medium to be heated and soiling or clogging may occur within them, too. This falsifies the corresponding measured values.

Moreover, such monitoring systems require separate measuring devices which would not be needed for the actual control of the heating installation. In this regard, the structural requirements for the heating installation are considerably increased by these monitoring systems.

Further, the values monitored may be variable by reason of the different designs of heating installations, which requires an adaptation of the monitoring device to the respective installation.

SUMMARY OF THE INVENTION

Proceeding from the problems described, it is the object of the invention to improve a method of monitoring the condition of soiling and/or calcification of the generic type with a view to its reliability and to reduce the structural requirements for putting it into practice.

This object is solved by a method of monitoring, wherein an initial condition, in particular when the heating installation is put into service initially, operational data occurring during the heating-up process are collected and stored as initial operational data in a storage device and wherein during the operation of the heating installation, the said operational data are collected in turns by the heating-up control device as subsequent operational data and compared with the stored initial operational data and wherein a condition of malfunction due to calcification and/or soiling of the heat exchanger is signalled by a defined deviation of the collected subsequent operational data from the collected initial operational data being exceeded. In this context the invention proceeds from the recognition that it is not necessary to have values that relate to the soiling and/or calcification of the heat exchangers, such as the pressure differences or the flow throughput per time unit, monitored via or by, the heat exchanger, but that it is sufficient to monitor characteristic operational data used in the control of the heating process in the heating installation. Certain operational data, namely the desired and actual temperatures of the heating medium and the medium to be heated or the pump-controlled flow rates of these two heating media are collected and control is made of their changing while the operation of the installation proceeds in time. For these operational data change characteristically, if for instance the heat exchanger gets clogged by deposits on the secondary side. This is explained in detail by way of the example of embodiment.

In short, it is sufficient for monitoring the condition of soiling and/or calcification of heat exchangers in heating installations to collect the operational data occurring during the heating-up process in an initial state, in particular when the heating installation is put into service for the first time, and to store them as initial operational data in a storage device, to have the mentioned operational data collected by turns as subsequent operational data by the heating-up control unit during the operation of the heating installation, to compare them with the stored initial operation data and to use any exceeding of a defined deviation of the subsequent operational data from the initial operational data as a criterion for overly calcification and/or soiling of the heat exchanger. In this case, a condition of malfunction of the heating-up control unit is signalled.

In this regard it is of advantage for the application of the method according to the invention that up-to-date heating-up control units of heating installations are, as a rule, configured as programmable microprocessor controls, into which the monitoring method according to the invention can be incorporated without any problems in terms of software by exploiting the method steps according to the invention. It is of advantage that there is no need to collect and store all operational data for monitoring purposes. It is sufficient if the monitoring is based on certain operational data—such as for instance the temperatures of the heating medium in the flow pipe and the return pipe—that are characterized by a significant change in the occurance of the cases of malfunction mentioned in the outset.

In short, the method according to the invention has several advantages. There is no need of additional measuring elements for instance for pressure differences between the supply and the discharge of the heat exchanger in the secondary circuit or of measuring gauges for the corresponding flow quantities per time unit. Reference is made to operational data furnished by measuring elements, such as temperature probes, anyhow available in the heating-up control unit, or which are used for the control itself, as for instance the rotational speed of the speed-controlled circulation pump in the primary circuit. In this regard, the method according to the invention does not give rise to the risk of the monitoring being impeded by deposits.

Different advantageous configurations of the method according to the invention are possible due to preferred embodiments. Further details of this are to be gathered from the description of the embodiments.

The preferred integrated collection of the initial and subsequent operational data helps avoid any faulty reaction of the monitoring device. As a result of chronological integration, any singular faulty measuring of, say, the temperature at the discharge, on the secondary side, of the heat exchanger—for instance due to some external trouble—is virtually of no importance.

Due to a preferred embodiment of the invention, the reliability of the collection of subsequent operational data is further increased by a multiplication of the aforesaid integral data by a correction value depending on the thermal conditions in the primary circuit, because the integral values of the initial and subsequent operational data are proportional to the supplied energy during the time of measuring. The operational data are, therefore, multiplied by a scaling factor reflecting the energy supplied to the heat exchanger, so that fluctuations in the energy supplied that would falsify the monitoring result do not have any impact.

According to a further preferred embodiment the collection in turn of the subsequent operational data and the latters' comparison with the initial operation data takes place whenever the heating installation is put into service. Thus, the frequency of application of the monitoring method is automatically oriented on the extent and frequency of duty of the heating installation itself.

Different kinds of reaction behavior of the heating installation as a result of the detection of malfunction conditions are possible, e.g. giving an acoustic or optical alarm signal or switching off the heating installation.

According to another preferred embodiment the occurance of some malfunction is recorded in an externally callable storage. This is a step for the protection of the person installation the heating installation. He can prove that when malfunction has occurred, the person operating the heating installation has disregarded for instance corresponding optical and/or acoustic warning signals contrary to any competent maintenance instruction and that he has caused for instance a total breakdown by continuing to operate the heating installation contrary to the instructions.

Further preferred embodiments of the invention relate to a heating installation for heating up a medium, in particular service water by means of a heating medium, in particular heating water, in which a monitoring device is provided putting the monitoring method according to the invention into practice. Further details of this can be taken from the description of the example of embodiment.

Further features, details and advantages of the invention will become apparent from the ensuing description, in which embodiments for the monitoring methods according to the invention as well as a corresponding heating installation are further specified taken in conjunction with the drawings.

DESCRIPTION OF THE PREFERRED EMBODIMENTS

Figure 1:
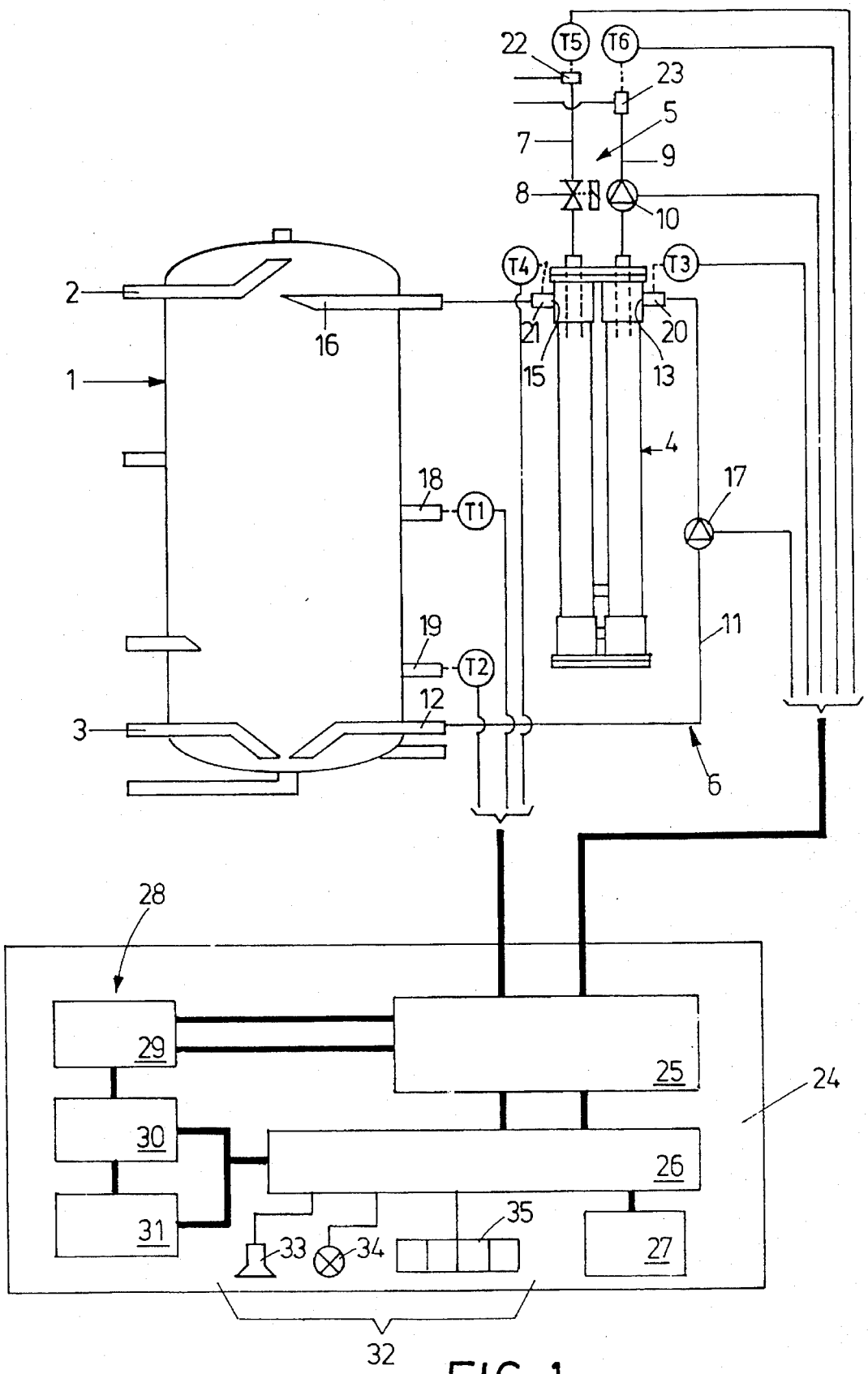
FIG. 1 is a diagrammatic illustration of a heating installation with a heating-up control device.

The heating installation shown in the drawings serves to heat up service water which is stored at a desired temperature of for instance 60° C. in the boiler 1. The latter has a hot-water discharge 2 as well as a cold-water supply 1 which are connected with corresponding hot-water taps and cold-water feeders.

A heat exchanger 1 is provided for heating the service water in the boiler 1, thermally linking a primary circuit 5 containing the heating water to a secondary circuit 6 containing the service water. The primary circuit 5 consists of a flow pipe 7 in which an electromagnetically actuatable check valve 8 is arranged to close the primary circuit 5. A speed controllable pump, namely the primary pump 10 for the circulation of the heating water in the primary circuit 5, is arranged in the return pipe 9. Flow pipe 7 and return pipe 9 are for example connected with a heating boiler, the temperature of the heating water in the flow pipe 7 being for instance 75° C.

The secondary circuit 6 consists again of a flow pipe 11 connecting the cold-water discharge 12 at the boiler 1 with the inlet 13, on the secondary side, of the heat exchanger 4. A return pipe 14 on the secondary side connects the latter's outlet 15 on the secondary side with the hot-water supply 16 of the boiler. A pump working at a constant speed when in operation, namely the secondary pump 17 for the circulation of the service water in the secondary circuit 11, is arrange din the flow pipe 11.

Temperature probes are located at different places of the heating installation. For instance, the temperature probe 18 is placed halfway up the boiler sensing the temperature T1 of the service water. Based on the latter the heating operation is started and the heating water circulation in the secondary circuit 6 and the primary circuit 5 is put into action.

The temperature probe 19 senses the service water temperature T2 in the lower portion of the boiler. If this temperature T2 reaches a certain desired temperature of for instance 60° C., the heating operation is terminated and a standstill function is triggered accompanied by the maintenance of standby conditions of the heating installation.

The temperature probe 20 senses the service water temperature T3 at the inlet 13, on the secondary side, of the heat exchanger 4. The temperature probe 21 takes the service temperature T4 at outlet 15, on the secondary side, of the heat exchanger 4, which temperature is set to a constant value of for instance 60° C. through the control of the heating installation in operation.

The temperature probes 22 and 23, respectively, are arranged in the flow pipe 7 and the return pipe 9, respectively, on the primary side and take the temperatures T5 and T6, on the flow side and the return side, of the heating water in the primary circuit 5. The temperatures T5 and T6 are for instance 75° C. and 65° C., respectively, the latter temperature T6 depending on the extent of energy taken out and the circulatory conditions in the heat exchanger 4.

The temperature probes 18 to 23 are connected with a heating-up control unit referenced by 24 as a whole and realized on the basis of a programmable microprocessor control. For the processing of the thermal operational data, namely the temperatures T1 to T6, the corresponding temperature signals from the temperature probes 18 to 23 are converted into digital data in an input/output unit, which digital data can be processed by the central processing unit 26 of the heating-up control unit 24. The processing unit 26 is of the type of a microprocessor with CPU, RAM and ROM memories. The primary pump 10 and the secondary pump 17 are also triggered by the input/output unit 25.

During normal operation the control of the heating-up process with the aid of the heating-up control device 24 takes place as follows:

Based on a desired value for the temperature T4 at the outlet 15 on the secondary side, stored in the processing unit 26 and to be entered by way of the input unit 27 (keyboard), the speed $n_P$ of the primary pump 10 and thus the flow rate of heating medium circulating in the primary circuit 5 is controlled such that the temperature T4 takes the desired value. A PID controller, as roughly outlined in FIG. 2, serves for the control of the speed. The secondary pump 17 is operated at a constant speed in the secondary circuit 6. It is only switched on or off by the heating-up control unit 24.

The two pumps 10, 17 may also be pulse-controlled as an alternative to the described triggering.

The further temperature probes T1 to T3, T5 and T6 serve for the verification of the thermal operational data during the heating-up control phase and to put the heating installation into service or to stop it. This takes place in the conventional way and needs no further explanation.

The heating installation is further provided with a monitoring device 28, which is functionally illustrated in the way of a block diagram in the attached drawing and which is integrated in the heating-up control unit 24. In practice the monitoring device is realized by a corresponding software concept of the program control of the heating-up control unit.

Functionally, the monitoring device 28 is provided with an acquisition device 29 for collecting the thermal operational data T1 to T6 and the operational data of the pump. The latter consist of the pump speed $n_P$ in the case of a speed controlled primary pump 10.

Further, the monitoring device 28 has a storage device 30, which may be formed by the storage unit (not shown) of the processing unit (26). In addition, a comparison device 31 is provided, the function of which may also be assumed in practice by the processing unit 26.

A buzzer 33 as an acoustic alarm as well as a warning light 34 as an optical alarm are provided for the signalling device 32. An alphanumerical display unit in the form of an LC display 35 is used in addition. The buzzer 33, the warning light 34 and the LC display 35 are controlled by the processing unit 26 in connection with the monitoring device 28. Likewise, an interface 42 is provided, via which alarm messages in the form of corresponding data can be transferred to peripheral units.

The method, according to the invention, of monitoring the condition of soiling and/or calcification of the heat exchanger works as follows:

When putting the heating installation into service for the first time, the operational data occurring during the heating-up process, namely the temperatures T1 to T6, and the pump speed $n_P$ of the primary pump 10 needed for setting the temperature T4 to a desired value, are collected by the acquisition device 29 and stored as initial operational data T1 to T6, $n_P$ in the storage device 30. The storing of the operational data is effected in the form of integral values detected by chronological integration of the operational data over a measuring period of for instance three minutes. Further, the maximally admissible deviations of the operational data during the subsequent operation from these initial operational data are defined in the storage device.

Each time the heating installation is started, once it has initially been put into service, the above-mentioned operational data are collected as subsequent operational data T1' to T6' and $n_P'$ by the acquisition device 29 and compared with the initial operation data T1 to T6 and $n_P$ stored in the storage device 30. In case the heat exchanger 4 is clogged in the vicinity of the secondary circuit 6, given a constant speed $n_S$ of the secondary pump 17, less service water per time unit is conveyed through the secondary circuit 6.

In this regard, less energy is taken out of the primary circuit 5, so that the primary pump 10 works at a lower speed $n_P'$ due to the heating-up control. Provided this value deviates for instance by more than 30% from the initial value $n_P$, this change of speed $\Delta n_P$ in the primary pump 10 is used as a criterion for the occurrence of malfunction, which is detected by the comparison device 31. Consequently, a corresponding acoustic and optical alarm is given by the signalling device via the buzzer 33 and the warning light 34. In like manner, a corresponding malfunction signal can be given by way of the LC display 5 and the malfunction signal can be stored in the way of a malfunction log in the externally callable storage device.

By the way, the above-mentioned integral values of the pump speed $n_P$, $n_P'$ can be multiplied by a correction value K during the collection of initial and subsequent data, the correction value K being proportional to the difference of the temperatures T6 and T6 of the heating medium in the flow pipe and the return pipe, respectively, of the primary circuit 5.

As a further alternative for a monitoring method according to the invention, the idea suggests itself, during the collection of the subsequent operational data, to convey the heating medium for a short time through the primary circuit 5 at the pump speed $n_P$ used during the initial operational data collection. If the heat exchanger is still not soiled, the desired temperature T4, given correspondingly coinciding temperatures T3, T6, will again occur at the output 15, on the secondary side, of the heat exchanger. If the heat exchanger 4 is clogged, the temperature T4' will considerably deviate from the temperature T4 occurring during the collection of the initial operational data and corresponding to a desired value, which can again be used as a criterion for the occurrence of some malfunction.

Figure 2:
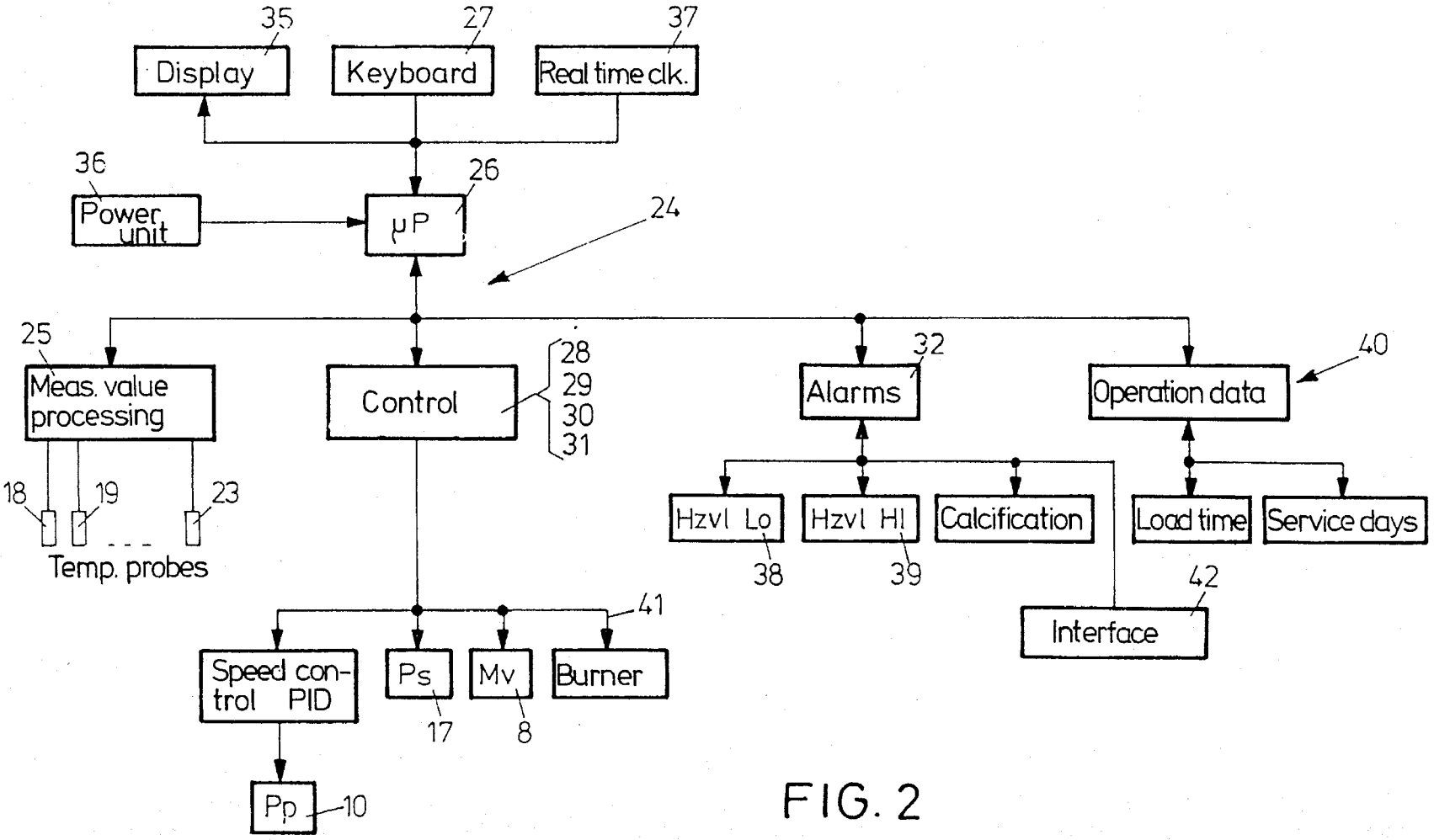
FIG. 2 is a diagram of the heating-up control device for the illustration of its basic structure as well as the linkage of internal functional groups.

Such parts and functional components as have been shown in FIG. 1 are provided with identical reference numerals in FIG. 2 Going beyond FIG. 1, FIG. 2 illustrates a power unit 36, a real-time clock 37, additional signalling devices in the form of warning displays 38 and 39, respectively, indicating too high and to low a flow temperature T5 in the primary circuit 5, an operational data output 40 for the charging time and the number of days of operation as well as a control branch 41 for a burner.

These components serve for the conventional operation of known heating installations and need no detailed discussion.

Summarizing it has to be emphasized that the following further operational data may alternatively be used for the monitoring of the condition of soiling and/or calcification:

T3: the temperature at the heat exchanger inlet 13 on the secondary side

T5: the temperature at the heat exchanger inlet on the primary side

T6: the temperature on the heat exchanger outlet on the primary side $n_S$: the pump triggering value for the secondary pump 17 (for speed and pulse control).

In the following a further example of monitoring the condition of soiling and/or calcification of the heat exchanger 4 on the basis of the above-mentioned temperatures T3, T5 and T6 is explained:

Given the non-soiled as-delivered state of the heat exchanger, the speed controlled primary pump 10 is started in a condition of operation as it is frequently to be expected when the installation is started and the desired value of the flow temperature T5 is reached at the heat exchanger inlet on the primary side. Then the non-controlled secondary pump 17 working at a constant speed is put into service. After removal of the accumulated heat in the heat exchanger 4, the desired temperature T4 is reached at the heat exchanger outlet 14 on the secondary side after a certain time (about 45 seconds) by correspondingly controlling the pump speed of the primary pump 10.

In this initial condition the so-called "initial measuring" is initiated manually and the temperature T3 at the heat exchanger inlet on the secondary side is taken and stored. Simultaneously, the integral value of the difference (T5–T6) of the temperature T5 and T6 at the heat exchanger inlet and outlet, respectively, on the primary side is collected for a time of t of for instance two minutes and divided by this time t. The result $(T5–T6)_m$ is stored and multiplied by a factor f in the range of form instance 0.3 to 0.8. This factor f is defined by way of a corresponding input at the heating-up control device 24 and determines the extent of deviation maximally admissible of the corresponding subsequent operational data.

During the operation of the heat exchanger, control measurements corresponding to the method according to the invention are automatically initiated upon each start of the heating-up control unit, provided the temperatures T3' and T5' correspond approximately to the temperatures T3 and T5 of the initial measuring.

Again, the integral value of the difference (T5'–T6') is collected over a certain period of time and divided by the time t. If the integral value $(T5–T6)_m'$ reaches the initially found integral values $(T5–T6)_m \times f$ or is lower than the latter, then an alarm function is triggered as explained above.

The temperatures T1, T2 are as a rule only used for the control of the heating installation, but not for the monitoring of soiling/calcification.

What is claimed is:

1. A method of monitoring the condition of soiling or calcification of heat exchangers (4) in heating installations comprising a boiler (1), a primary circuit (5) containing a heating medium, a secondary circuit (6) containing a medium to be heated, a primary pump (10) in the primary circuit (5) and a secondary pump (17) in the secondary circuit (6), the heating-up process of the medium to be heated being controlled on the basis of operational data, namely of temperatures T1 to T6 of the heating medium and of the medium to be heated as well as of triggering data $n_S$, $n_P$ for pumps (10, 17) for conveying the heating medium and the medium to be heated through the heat exchanger by means of a heating-up control device (24), wherein in an initial condition, operational data T1 to T6, $n_P$ occurring during the heating-up process are collected and stored as initial operational data T1 to T6, $n_P$ in a storage device (30), wherein during the operation of the heating installation, the said operational data are collected in turns by the heating-up control device (24) as subsequent operational data T1' to T6', $n_P'$ and compared with the stored initial operational data T1 to T6, $n_P$, wherein a condition of malfunction due to calcification or soiling of the heat exchanger (4) is signalled by a defined deviation ($\Delta n_P$, $\Delta T4$) of the collected subsequent operational data T1' to T6', $n_P'$ from the collected initial operational data T1 to T6, $n_P$ being exceeded, and wherein said initial operational data T1 to T6, $n_P$, $n_P'$ and $n_S$ and said subsequent operational data T1' to T6' and $n_P'$ are defined as T1 and T1': initial and subsequent temperatures in the boiler (1) at an upper location, T2 and T2': initial and subsequent temperatures in said boiler (1) at a lower location, T3 and T3': initial and subsequent temperatures at an inlet (13) of the secondary circuit (6) of the heat exchanger (4), T4 and T4': initial and secondary temperatures at an outlet (15) of the secondary circuit (6) of the heat exchanger (4), T5 and T5': initial and subsequent temperatures on a flow side of the primary circuit (5), T6 and T6': initial and subsequent temperatures on a return side of the primary circuit (5), $n_S$: speed of the secondary pump (17) and $n_P$ and $n_P'$: initial and subsequent speeds of the primary pump (10).

2. A method according to claim 1, wherein during the collection of the initial and subsequent operational data, the temperatures T5, T4 in the heating medium flow pipe (7) in the primary circuit (5) as well as at the heat exchanger outlet (15) in the secondary circuit (6) are being kept constant as thermal operational data by the heating-up control unit and the change ($\Delta n_P$) of the triggering data for at least one of the pumps (10, 17) for conveying the heating medium and the to-be-heated medium between the collection of the initial operational data and that of the subsequent operational data are used as a criterion for the occurrence of some malfunction.

3. A method according to claim 2, wherein the medium to be heated is conveyed at a temporally constant pump speed $n_S$ in the secondary circuit (6), and wherein the speed change ($\Delta n_P$) of the speed controlled pump (10) in the primary circuit (5) between the collection of the initial operational data and that of the subsequent operational data is used as a criterion for the occurrence of some malfunction.

4. A method according to claim 1, wherein during the collection of the initial and subsequent operational data, the temperature T5 in the heating medium flow pipe (7) in the primary circuit (5) and the triggering data $n_P$, $n_S$ for the pumps (10, 17) for conveying the heating medium and the medium to be heated in the primary circuit (5) and the secondary circuit (6) are being kept constant for a short time and the change of at least one of the temperature T4 of the medium to be heated at the heat exchanger outlet (15) of the secondary circuit (6) and of the temperature T6 in the heating medium return pipe (9) in the primary circuit (5) between the collection of the initial and the subsequent operational data is used as a criterion for the occurrence of some malfunction.

5. A method according to claim 1, wherein the collection of the initial and subsequent operational data takes place integratingly over a settable period of time.

6. A method according to claim 1, wherein during the collection of the initial and the subsequent operational data, the temperatures T5, T6 of the heating medium in the flow pipe (7) and in the return pipe (9), respectively, are collected and the change in the difference T5 to T6, integrated over a period of time ($\Delta t$), of the two mentioned temperatures (T5, T6) of the heating medium is used as a criterion for the occurrence of some malfunction.

7. A method according to claim 3, wherein during the collection of the initial and the subsequent operational data, integral values of the pump speed $n_P$ are multiplied by a correction value (K) formed from the difference of the temperatures T5, T6 of the heating medium in the flow pipe (7) and the return pipe (9), respectively, of the primary circuit (5).

8. A method according to claim 1, wherein the collection of the subsequent operational data and the comparison of the corresponding subsequent operational data T1' to T6'; $n_P'$, $n_S'$ with the initial operational data T1 to T6, $n_P$, $n_S$ are performed each time the heating installation is started.

9. A method according to claim 1, wherein upon detection of some malfunction, at least one action of giving an optical alarm signal, giving an acoustic alarm signal and switching off the heating installation is generated.

10. A method according to claim 1, wherein the occurrence of malfunction is recorded in an externally callable storage.

11. A heating installation for heating up a medium by means of a heating medium comprising a primary circuit (5) for the heating medium, a secondary circuit (6) for the medium to be heated, which circuit is preferably connected with a boiler (1) for the medium to be heated, a heat exchanger (4) for the thermal coupling of the primary circuit (5) and the secondary circuit (6), a controlled circulation primary pump (10) in the primary circuit (5), a circulation secondary pump (17) in the secondary circuit (6), temperature probes (18 to 23) at least in the heating medium flow pipe (1) and return pipe (9) in the primary circuit (5) as well as at the heat exchanger inlet (10) and outlet (15) in the secondary circuit (6), a heating-up control device (24), which while collecting operational data T1 to T6 generated by the aforementioned temperature probes (18 to 23), controls the primary and secondary pumps (10, 16) in the primary circuit (5) and the secondary circuit (6) in accordance with settable desired values with the aid of corresponding pump operational data ($n_P$, and a monitoring device (28) for putting into practice a method of monitoring the condition of soiling or calcification of heat exchangers (4) in heating installations comprising a boiler (1), a primary circuit (5) containing a heating medium, a secondary circuit (6) containing a medium to be heated, a primary pump (10) in the primary circuit (5) and a secondary pump (17) in the secondary circuit (6), the heating-up process of the medium to be heated being controlled on the basis of operational data, namely of temperatures T1 to T6 of the heating medium and of the medium to be heated as well as of triggering data $n_S$, $n_P$ for pumps (10, 17) for conveying the heating medium and the medium to be heated through the heat exchanger by means of a heating-up control device (24), wherein in an initial condition, operational data T1 to T6, $n_P$ occurring during the heating-up process are collected and stored as initial operational data T1 to T6, $n_P$ in a storage device (30), wherein during the operation of the heating installation, the said operational data are collected in turns by the heating-up control device (24) as subsequent operational data T1' to T6', $n_P'$ and compared with the stored initial operational data T1 to T6, $n_P$, wherein a condition of malfunction due to calcification or soiling of the heat exchanger (4) is signalled by a defined deviation ($\Delta n_P$, $\Delta T4$) of the collected subsequent operational data T1' to T6', $n_P'$ from the collected initial operational data T1 to T6, $n_P$ being exceeded, wherein said initial operational data T1 to T6, $n_P$, $n_P'$ and $n_S$ and said subsequent operational data T1' to T6' and $n_P'$ are defined as T1 and T1': initial and subsequent temperatures in the boiler (1) at an upper location,

T2 and T2': initial and subsequent temperatures in said boiler (1) at a lower location,

T3 and T3': initial and subsequent temperatures at an inlet (13) of the secondary circuit (6) of the heat exchanger (4),

T4 and T4': initial and secondary temperatures at an outlet (15) of the secondary circuit (6) of the heat exchanger (4),

T5 and T5': initial and subsequent temperatures on a flow side of the primary circuit (5),

T6 and T6': initial and subsequent temperatures on a return side of the primary circuit (5), $n_S$: a speed of the secondary pump (17) and $n_P$ and $n_P'$: initial and subsequent speeds of the primary pump (10), and wherein the monitoring device (28) comprises an acquisition device (29) for collecting temperature and pump operational data T1 to T6, $n_P$, $n_S$, a storage device (30) for storing the initial operational data T1 to T6, $n_P$, $n_S$ collected in an initial condition of the heating installation, and the admissible deviations of the subsequent operational data T1' to T6', $n_P'$ from the initial operational data T1 to T6, $n_P$, $n_S$, a comparison device (31) for comparing the stored initial operational data T1 to T6, $n_P$, $n_S$ with the subsequent operational data T1' to T6', $n_P'$, $n_S'$ collected in turns and for finding a condition of malfunction when the admissible deviation of the subsequent operational data T1' to T6', $n_P'$, $n_S'$ from the initial operational data T1 to T6, $n_P$, $n_S$ is exceeded, as well as a signalling device (32) for emitting a malfunction signal in case some malfunction is found.

12. A heating installation according to claim 11, wherein the acquisition device (29), the storage device (30) and the comparison device (31) are integrated in the heating-up control device (24).

13. A heating installation according to claim 11, wherein the acquisition device (29), the storage device (30) and the comparision device (31) are formed as a program-controlled microprocessor system (26).

14. A heating installation according in claim 11, wherein the signalling device (32) is formed as at least one of an acoustic alarm (33), optical alarm (34), alphanumeric display unit (35) and data interface (42) for peripheral installations.

* * * * *